United States Patent [19]

Bumgarner et al.

[11] 4,201,299

[45] May 6, 1980

[54] BAG

[76] Inventors: Robert L. Bumgarner, 7505 SW. 82 St.; Arthur O. Knutson, 1164 SW. 67th Ave., both of Miami, Fla. 33143

[21] Appl. No.: 913,200

[22] Filed: Jun. 6, 1978

[51] Int. Cl.[2] ..... B65D 85/62

[52] U.S. Cl. ..... 206/554; 206/806; 229/53; 229/74

[58] Field of Search ..... 206/554, 806, 526, 390; 229/53, 54 R, 74, 69

[56] References Cited

U.S. PATENT DOCUMENTS

| | | | |
|---|---|---|---|
| 1,529,381 | 3/1925 | Townsend | 229/74 |
| 3,151,668 | 10/1964 | Zimmermann | 229/69 |
| 3,254,828 | 7/1966 | Lerner | 229/69 |
| 3,285,406 | 11/1966 | Winesett | 206/554 |
| 3,285,407 | 11/1966 | Abramson | 206/554 |
| 4,059,222 | 11/1977 | Gamble | 229/54 R |

*Primary Examiner*—William T. Dixson, Jr.
*Attorney, Agent, or Firm*—Laff, Whitesel & Rockman

[57] ABSTRACT

A plastic bag is made from any suitable material, such as polyethylene film, with a perforated slit formed therein, so that the bag may be hung on a doorknob, hook, or the like. The bag may be used to protect a newspaper or other item intended to be left at a door.

15 Claims, 6 Drawing Figures

BAG

This invention relates to plastic bags and more particularly to bags primarily designed to hang from doorknobs and to contain any suitable item which may be left at a door.

Plastic bags of the type described herein are generally sleeve-like devices made from sheets of plastic, with a hole formed near their top. The hole has dimensions such that the bag may be hung over a doorknob. Usually, a plurality of these bags are manufactured and assembled into a tablet-like form, which tablet may be hung on any suitable anchor point, such as a hook. A free edge on the bag top may be pulled outwardly from the tablet, and a rolled paper (or the like) may be inserted into the bag. Then, the entire bag may be pulled or otherwise separated from the tablet, with the newspaper in it. This way, the bags may be stuffed quickly and easily.

Once the stuffed bags are separated from the tablet, they may be carried to customers' or subscribers' homes, where they are hung over a front doorknob, for example. These plastic doorknob bags are used to protect the items stuffed therein from dirt, rain, snow, or the like.

A characteristic of doorknob bags is that they should require a minimum amount of labor to stuff them. They should be low-cost since they are used only once and then discarded. They should withstand the rough treatment of the stuffing, transporting, hanging and of the exposure to the elements when hung on the door. Generally, these bags are made from flexible, low-density polyethylene resin. Since the raw material cost is a significant factor in the cost of the bag, any saving of plastic reduces the cost and concomitant price of the bag and represents a substantial advance in the state of the art.

Accordingly, an object of the invention is to provide new and improved doorknob bags, or the like, which employ less plastic material than heretofore used for similar bags and are lower in cost.

Another object of the invention is to provide plastic doorknob bags which are especially well-suited for use with newspapers or other like items and which will not tear when applied to doorknobs, hooks or other hangers. The bag also must be sufficiently strong so that it will stay on the doorknob after its application thereto.

Another object is to provide a doorknob bag which is easier to process on bag-making machinery and which may be easier packed than the prior art bags. Further objects will become more apparent from the following description, drawings and claims.

These and other objects of the invention are accomplished by providing a bag which has an opening at one end and an appropriate slit formed near the open end, as distinguished from a circular hole for receiving the doorknob. The slit, which is preferably arched with the curved ends pointing downwardly from the bag opening, leaves an unbroken section of the plastic bag material above the doorknob. The bag material used for this bag may have approximately the same strength as the material that was left in the older style bag which has a hole. The slit permits the bags to be shorter than the prior art bags, thus saving plastic and affording a lighter weight bag. The smaller, lighter bag saves shipping box material, because more bags may be packed in a shipping box than heretofore. The slit is perforated and is not opened until the bag is put into use, thereby making the bag easier to pack with a newspaper or other article because the inserted article does not tend to snag in a hole. Slitting the bag, rather than punching out plastic material to form a hole in the bag, makes it easier to process the bags on the bag-making machinery.

The invention may be further understood from a study of the attached drawings, wherein.

Figure 1:
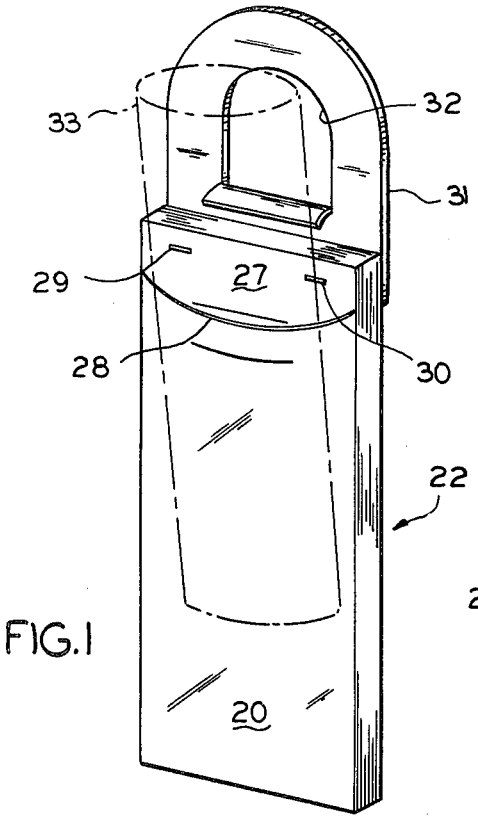
FIG. 1 is a perspective view of a tablet of plastic bags with a paper, or the like (shown in phantom), being stuffed into the bag.
Figure 2:
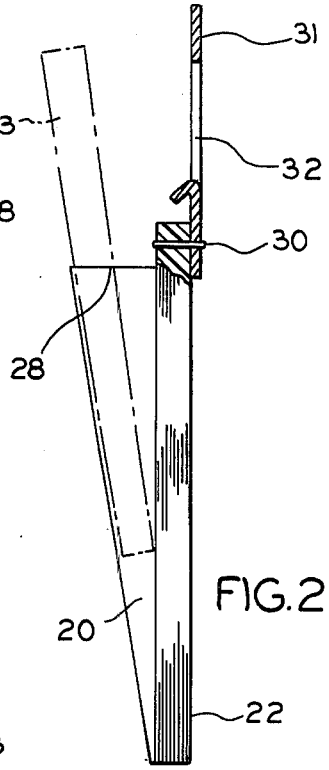
FIG. 2 is a side view of the structure of FIG. 1.

As best seen in FIGS. 1 and 2, a plurality of the plastic bags 20 (often 100 bags) are generally manufactured and then joined together somewhat as a tablet 22. Each bag 20 might begin as a sheet of plastic which is folded along a line 23 and welded along the two edges 24,25, perpendicular thereto. Or, alternatively, the bag may be a seamless, extruded, continuous tube which is wound upon a roll. Either way, the final product is a generally sleeve-like bag member which is closed on three edges 23-25 and open at the top edge 26. Preferably, one top edge 27 of the sleeve-like bag projects beyond another and free, top edge 28 to provide a tab-like member. If desired, the bag may be perforated near the top edge 27 to facilitate its removal from the tablet 22.

The tablet is formed by stapling (at 29,30) a plurality of the extending tab-like members 27 of the bags to a handle, header, or anchor member 31.

Figure 6:
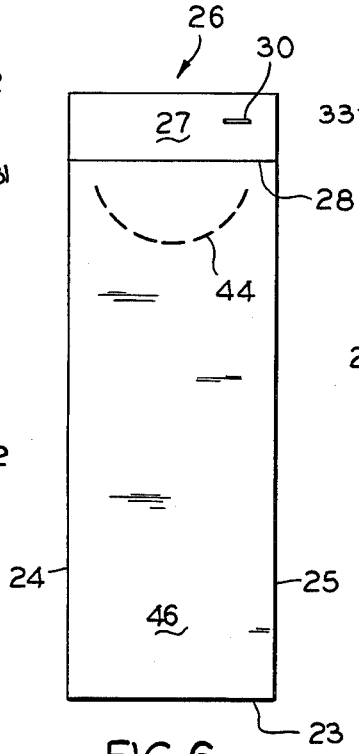
FIG. 6 is a plan view of a third embodiment of the invention.

In some embodiments, only one staple is used, as shown at 30, in FIG. 6. The decision of how many staples to use depends somewhat upon the weight and physical characteristics of the bag and the item being inserted into the bag. As shown in FIGS. 1 and 2, the member 31 includes a hole 32 which is proportioned to be hung over or anchored to any suitable stationary member such as a hook, nail or the like.

The items 33 (FIGS. 1 and 2) which are to be stuffed into the bags 20 may take any suitable form. For example, they may be rolled or folded shoppers, newspapers, advertisements, folders, utility bills, or the like. (A "shopper" is a few pages of advertisements which are printed very much like a sub-tabloid-sized newspaper and distributed door to door, usually by private distribution services acting for local merchants.) To stuff each bag, the top bag edge 28, which is free of the staples 29,30, is pulled outwardly, and the stuffing item 33 is inserted therein, while the back and projecting end 27 of the bag is held by the staples. Then, the stuffed bag is pulled from the tablet with the projecting bag side 27 being torn from the staples 29,30. Next, the top edge 28 of the next bag is pulled out to receive the next stuffing item. The process is repeated as often as may be required.

Figure 3:
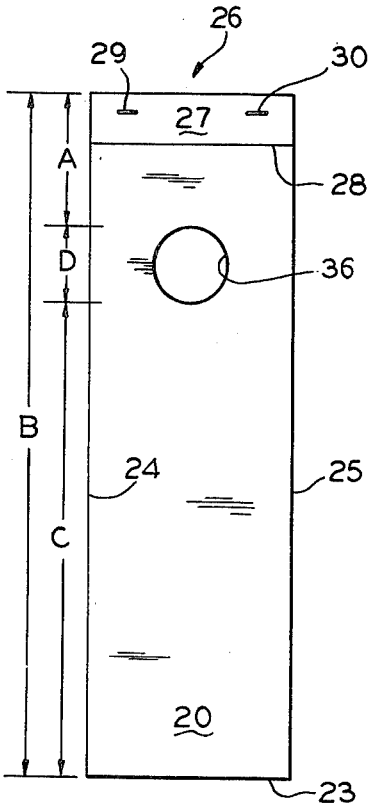
FIG.3 (PRIOR ART)
FIG. 3 is a plan view of the prior art doorknob bag.

The prior art bags were constructed, as shown in FIG. 3. A hole 36 is formed in any suitable manner through both sides of each bag to enable it to be hung over a doorknob. The hole is displaced downwardly from the top of the bag, by a distance A, which is required to insure adequate bag strength so that it will not tear loose or stretch and be dislodged from the doorknob. The strength of the plastic above the knob must be adequate to support the heaviest object likely to be stuffed into the bag 20, which may vary with the size of the bag.

The prior art bag has a total length B which extends below the hole 36 for a distance C, which is far enough to receive and enclose the largest item likely to be stuffed into the bag. For example, the distance C might be the length of a folded shopper, newspaper, or the like. In the bag, all space other than that actually required to receive and enclose the stuffed item represents a potential waste of plastic. In this prior art bag of FIG. 3, the plastic material wasted at A is provided in order to insure adequate strength in the plastic above the doorknob. The plastic material wasted at D is provided so that the hole 36 may be large enough to slip over a doorknob. Moreover, the cost of shipping boxes and of shipping becomes greater as the bags become larger.

By providing in bag 39 a straight slit 38 (FIG. 4) which is wide enough to receive the doorknob in place of the hole 36, the vertical dimension D of the doorknob hole is eliminated (the distance D is usually $1\frac{3}{4}$ to 2 inches, but may be larger). Preferably, the slit is made in both sides of the bag. The slit is preferably perforated and not cut through since it holds the plastic together and enables it to feed smoothly through bag-making machines without snagging. The perforations will generally open when the bag is loaded, especially if a loaded bag is held above the perforations and snapped with a quick wrist movement, while in the air.

Figure 4:
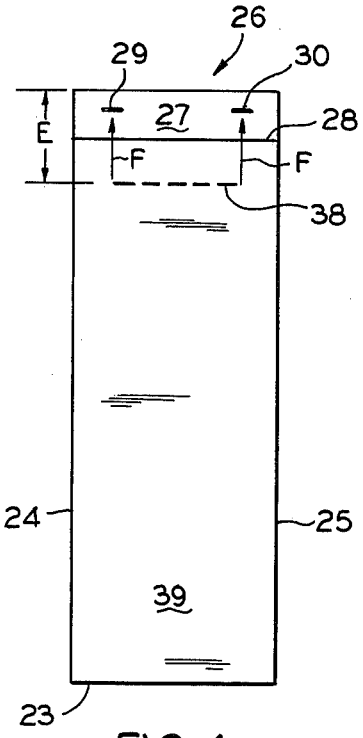
FIG. 4 is a plan view of a first embodiment of the invention.

The embodiment of FIG. 4 is best used when the entire weight of the stuffed item is quite light, such as invoices of public utility companies, for example. There is a tendency for the material to tear at the ends of a straight slit 38 when it must support heavy weights. Nevertheless, there is a substantial savings of plastic, when a straight slit is used.

To further improve the strength of the bag, the slit may be arched (as at 40 in FIG. 5) so that there will be less tendency for it to tear by the weight of the stuffed item. If the slit were not arched, it might have a tendency to tear at its opposite ends when the bag was stuffed.

Bag 42 with the arched slit 40 (FIG. 5) performs substantially as well as the bag 20 with the circular hole 36 (FIG. 3), but the overall length K of bag 42 is shorter, by the distance L (FIG. 5), than the overall length B, of the prior art bag 20, with no appreciable difference in its service characteristics. Thus, on every bag made, the material required to extend the bag over the added distance L is saved.

Figure 5:
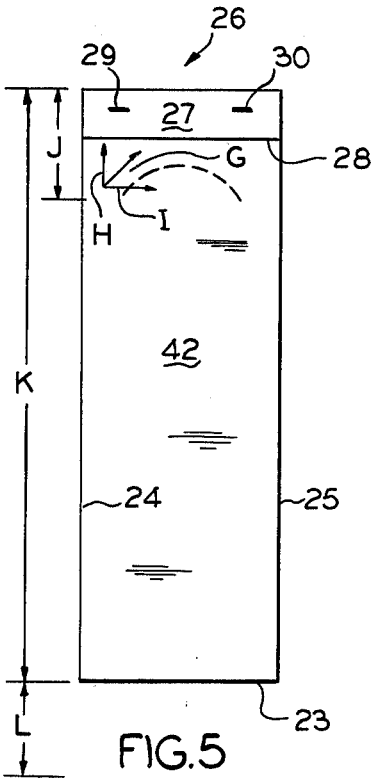
FIG. 5 is a plan view of a second embodiment of the invention.

In FIG. 5, the slit 40 arches upwardly (frowns) while the arch 44 of bag 46 shown in FIG. 6 curves downwardly (smiles). The "frown" embodiment of FIG. 5 is generally preferred since it tends to support a greater weight. However, the "smile" embodiment of FIG. 6 sometimes may have an advantage since it may be easier to stuff some items into a bag of this configuration. The straight slit 38 embodiment of FIG. 4 is preferred if the stuffed item is of negligible weight.

An added advantage grows out of the use of a slit, as compared to the prior art use of the hole 36, since the slit may be perforated and not opened until the bag is put into use. This allows the plastic material to feed more smoothly through the automatic machinery for making the bags and also aids in packing the bags. During stuffing, when the top bag edge 28 is pulled out and the stuffed item 33 is inserted, there is no large hole 36 which is standing open to snag the end of the inserted item. Rather, the perforations of the slit hold together the abutting edges of the plastic material so that the stuffed item slides smoothly and easily into the bag. The chances of snagging are substantially reduced.

Further advantages are: (1) the bags without the doorknob hole 36 can be drawn much faster through a bag-making machine because the hole causes more stretch and distortion in the bag and uneven pulling; (2) the bags without a hole may be aligned and stacked more easily because the slit reduces the bag distortion that is present when a hole is made in the bag; (3) the easier aligning and stacking makes it easier to fasten the bags to the header 31; and (4) there is no scavenging problem of collecting or cleaning up the disks punched out of the plastic to form the bag holes 36.

Those who are skilled in the art will readily perceive how improvements and modifications may be made, within the scope and the spirit of the invention; therefore, the appended claims are to be construed to cover all equivalent structures.

I claim:

1. A plastic bag comprising an elongated tubular, thin plastic film member which has two opposed sides, is closed on one end, and has at least one open edge on the other end, and hang means comprising a horizontally oriented slit means formed through both sides of the thin plastic film member and near the open edge at the other end thereof, for hanging the bag on an object, said slit having a length which is large enough to fit over the object and being surrounded by an unbroken area of film.

2. The bag of claim 6 wherein said slit is a single straight line which is parallel to the open side or end of said tubular member.

3. The bag of claim 6 wherein said slit is a single line which is arched downwardly toward the closed side or end of said tubular member and large enough to hang from a doorknob.

4. The bag of claim 6 wherein said slit is a single line which is arched upwardly toward said open side or end of said tubular member bag.

5. The bag of claim 4 wherein one side of the open end of said bag projects beyond the open edge which is on the other side of said open end to provide a tab-like member.

6. The bag of claim 5 wherein a plurality of said tab-like members are joined together to form a tablet of said bags, and means for anchoring said joined tab-like members to enable the side of the bag opposing the tab-like member to be pulled away for stuffing while the tablet is anchored.

7. The bag of claim 1 wherein said slit is a single line which is perforated so that the slit does not open until the bag is put into use.

8. The bag of claim 7 wherein said perforated slit is arched upwardly toward said open side or end and is sized to hang from a doorknob.

9. The bag of claim 8 wherein the slit is configured to fit over a doorknob.

10. The bag of claim 9 wherein the plastic material is polyethylene.

11. A process for making thin plastic film bags comprising the steps of:

(a) forming said plastic film into tubular-shaped bags which have opposed sides and are closed on three edges and opened on a fourth end, and (b) perforating areas of said film aligned on both of said opposed sides of said bag with an arcuate slit positioned horizontally near said opened end.

12. The process of claim 11 and the added steps of:

(c) forming one side of the open end of said bag longer than the opposing side of the open end to form a tab-like member, (d) fastening together a plurality of said tab-like members to form a tablet of said bags, and (e) forming an anchor point on said tablet at a point where said bags are fastened together for holding said tablet stationary while said bags are being stuffed.

13. A plastic bag comprising an elongated tubular, thin plastic film member which has two opposed sides, is closed on one end, and has at least one open edge on the other end, and hang means comprising a single line horizontally oriented, arched slit means formed through both sides of the thin plastic film member and near the open edge at said other end thereof, for hanging the bag on an object, said slit having a length which is large enough to fit over the object and being surrounded by an unbroken area of film.

14. The bag of claim 13 wherein said single line slit is arched downwardly toward the closed side or end of said tubular member and large enough to hang from a doorknob.

15. The bag of claim 13 wherein said single line slit is arched upwardly toward said open side or end of said tubular member bag.

* * * * *

UNITED STATES PATENT AND TRADEMARK OFFICE

CERTIFICATE OF CORRECTION

PATENT NO. : 4,201,299

DATED : May 6, 1980

INVENTOR(S) : Robert L. Bumgarner & Arthur Knutson

It is certified that error appears in the above—identified patent and that said Letters Patent is hereby corrected as shown below:

Claim 2, line 1, "claim 6" should be --claim 1--.

Claim 3, line 1, "claim 6" should be --claim 1--.

Claim 4, line 1, "claim 6" should be --claim 1--.

Signed and Sealed this

*Twenty-first* Day of *September 1982*

[SEAL]

*Attest:*

GERALD J. MOSSINGHOFF

*Attesting Officer*

*Commissioner of Patents and Trademarks*